United States Patent [19]

Beghelli

[11] Patent Number: 4,929,192

[45] Date of Patent: May 29, 1990

[54] CONNECTION AND FIXING SYSTEM FOR ELECTRONIC UNIT

[76] Inventor: Gian Pietro Beghelli, Via J. Barozzi 6, Monteveglio (BO), Italy

[21] Appl. No.: 213,174

[22] Filed: Jun. 29, 1988

[51] Int. Cl.[5] ..... H01R 13/60

[52] U.S. Cl. ..... 439/534; 439/131

[58] Field of Search ..... 439/534, 571, 573, 131, 439/690

[56] References Cited

U.S. PATENT DOCUMENTS 2,714,711 8/1955 Crane ..... 439/690 X 2,866,956 12/1958 Miller et al. ..... 439/131

FOREIGN PATENT DOCUMENTS 0041108 4/1978 Japan ..... 439/571

*Primary Examiner*—Eugene F. Desmond

[57] ABSTRACT

The present invention relates to an improved connection and fixing system for electronic unit which connects, with a single operation, a unit including an electronic part to a housing or containing casing previously fixed to a wall or ceiling, which in its turn is easily connected to the electric supply network, with mechanical fixing both of the electronic unit and of a shield to the casing, with a rapid and easy closure system for the assembly.

6 Claims, 2 Drawing Sheets

CONNECTION AND FIXING SYSTEM FOR ELECTRONIC UNIT

FIELD OF THE INVENTION

The present invention relates to an improved connection system for electronic apparatus, e.g. lamps, smoke detectors, installed on walls or ceilings. In particular the present invention relates to a system for electrical connection of a unit complete with electronic part to a supporting/containing casing, for mechanical fixing of the unit complete with electronic part to said supporting/containing casing and to a shield, and for connection of the casing to the electrical supply cables.

BACKGROUND OF THE INVENTION

It is known that conventionally, e.g. in the production of lamp installations for industrial-type lighting having a fluorescent tube or having incandescent bulbs made up of a containing body or casing of heat-resistant or self-extinguishing polycarbonate and a transparent diffuser shield, there are normally tow members: terminal board and connectors, combined or independent.

It is also known that, according to conventional technology, the electrical supply cables are first installed in ducts in a wall or ceiling, their ends being left projecting, and being prepared and stripped for introduction into the containing casing or box and being fixed one by one to the terminal board by the action of tightening screws with a screwdriver, their ends first being bent and fitted in the said terminal board.

The connection of the terminal board to the electronic unit requires a second operation comprising manual action which are inconvenient and neither simple nor rapid. Once the above operations have been performed, the containing box or casing is fixed to the wall or to the ceiling, and the components complete with electronic part, and a shield, are fixed to the said box in a subsequent operation.

The casing is fixed to the wall or ceiling mechanically, by means of screws which engage in expansion plugs inserted in holes previously made in the wall or ceiling. The relative fixing of the parts of the assembly is accomplished in the conventional known technology, by means of screws.

It is also known to replace fixing by means of screws with a pin bearing a second transverse pin which fixes the parts by entering into a groove in the part to be joined and wich is rotated in position; the specific transverse perforation of the first pin and the introduction of a transverse pin into the hole are necessary to obtain fixing.

A common feature of the prior art systems is that the replacement of parts which, for whatever reason, are no longer operational requires the assembly to be dismantled under inconvenient operating conditions entailing long working periods.

OBJECTS OF THE INVENTION

It is object of the present invention to provide a system of rapid electrical connection of the terminals of the cables and of the electronic unit to the terminal board.

Another object is to provide the rapid mechanical fixing of parts including the covering shield, to the containing casing.

Another object also is to provide a quick snap on system suited to connect a lamp to a bracket with one only easy operation, said bracket acting as both mechanical and electrical connection.

SUMMARY OF THE INVENTION

This and other objects of the invention that will better appear afterwards are obtained by an improved connection and fixing system for electronic unit comprising a box-type housing having removably mounted thereon a terminal board/ connector unit for the electrical connection of terminals of supply cables to an electronic unit; a support frame bearing said electronic unit; a shield member; means for fixing said support frame to the box-type housing; means for fixing said shield member to the box-type housing/support frame assembly; and means for connecting and fixing the lamp body on a support bracket directly.

In a preferred embodiment of the invention connector elements and a terminal board are arranged on a rotatable support which also bears female sockets. The arrangement of connector elements, terminal board and female sockets on the rotatable support is such that when the rotatable support is in a first position the connection of the ends of supply cables to the connector elements and terminal board is facilitated, and when the rotatable support is in a second position the connection of male connector parts provided on a unit complete with electronic part to the female sockets is facilitated. The support is rotatable between the first and second positions (which typically may be separated by around 90°). The mechanical fixing is of the "bayonet" type, produced by means of an integral pin moulded in plastics and designed with transverse appendixes capable of being introduced into appropriate notches in a manner such that, by rotating the pin on its axis with a screwdriver or other means and by the action of an opposing spring along the stem, simple, rapid, economical and secure fixing is achieved. Two sockets for two "bayonet" fixing pins internally fix the frame of the unit complete with electronic part to the housing or casing members; a further two similar sockets close the entire assembly with a shield member in the form of a lid.

Embodiments of the invention also permit to fasten a bracket to the wall or ceiling which bears an electronical connector to join to the external cables and to slide a lamp body on the said bracket, on which it is secured using a latch type device, the said lamp body being complete with the electric connector corresponding with the one of the said bracket so as to carry out a male/female connection between the said connectors.

SPECIFIC DESCRIPTION

Figure 3:
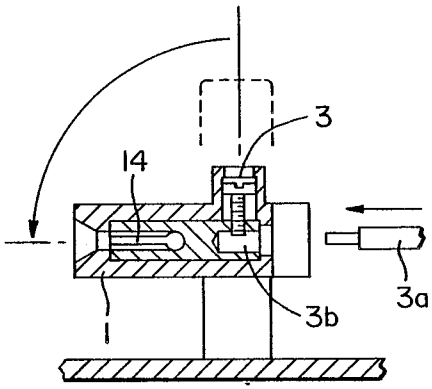
FIG. 3 shows diagrammatically a lateral section of the rotatable support of FIG. 1, in a position facilitating connection of the mains supply leads, receiving an end of a supply lead.
Figure 2:
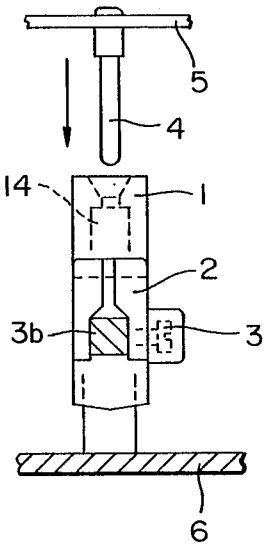
FIG. 2 shows diagrammatically a partial lateral section of the rotatable support of FIG. 1 receiving a contact pin of the reflector unit with electronic part.
Figure 1:
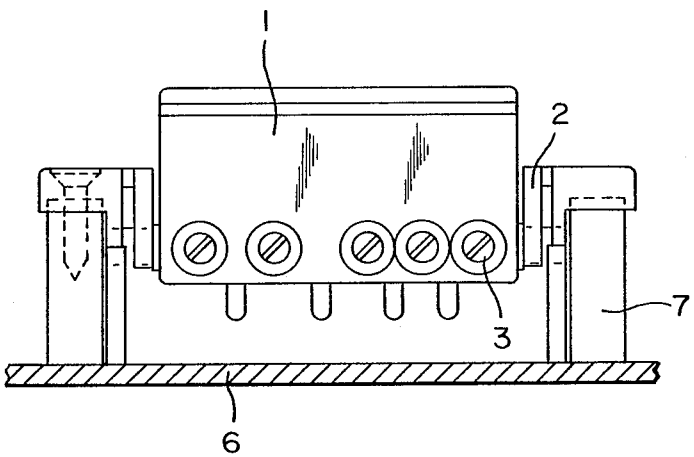
FIG. 1 shows diagrammatically top plan view of a rotatable support, in a position facilitating connection to a reflector unit with electronic part, of an electronic lighting unit embodying the invention.
Figure 6:
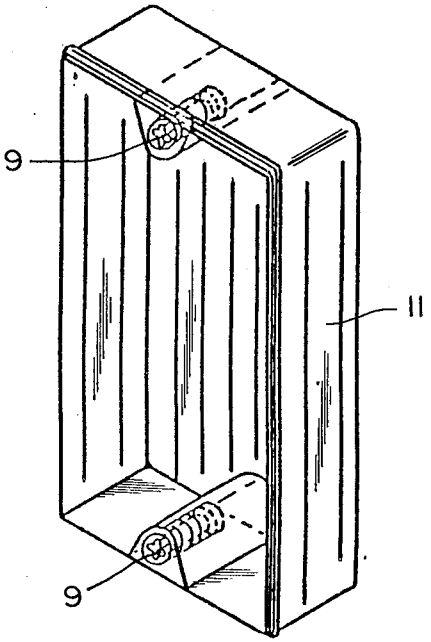
FIG. 6 shows a perspective view of a shield part of the electronic lighting unit of FIG. 1.
Figure 5:
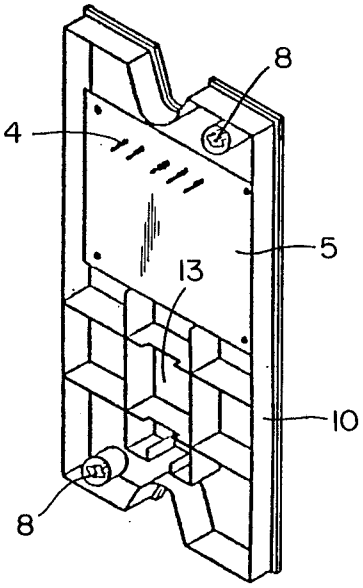
FIG. 5 shows a perspective view of the reflector unit with electronic part of the electronic lighting unit of FIG. 1, which supports the bulb reflector at the front and the electronic part and the sockets for any batteries at the back.
Figure 4:
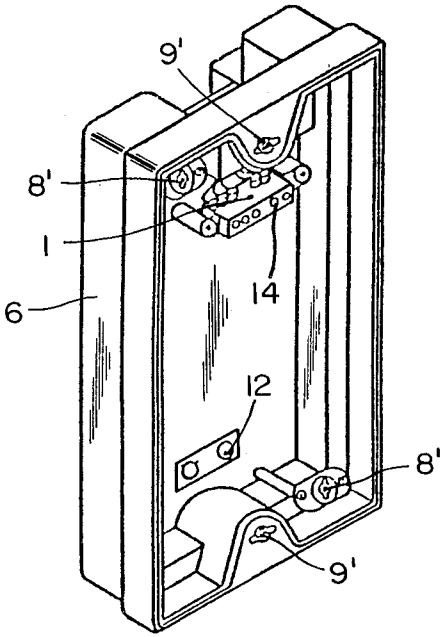
FIG. 4 shows a perspective view of a supporting/continuing casing of the electronic lighting unit of FIG. 1.
Figure 10:
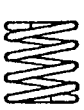
FIG. 10 shows a helical compression spring which is introduced and retained in the stem of the pin according to FIG. 7 and FIG. 8, capable of exerting the force opposing the locking and retention of the pin once it is introduced into position.
Figure 9:
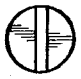
FIG. 9 shows a top view of the pin of FIG. 7 showing a notch in the head of the pin for rotation thereof.
Figure 8:
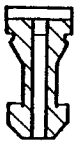
FIG. 8 shows a further sectional view of the pin of FIG. 7 taken along line A—A'.
Figure 7:
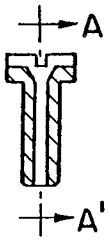
FIG. 7 shows a sectional view of a pin, of moulded plastics material, for mechanical fixing used in the electronic lighting unit of FIG. 1.

The connector unit 1 rotates about its horizontal axis, with the bracket 2 which retains it on the support socket. The series of connector screws 3 fix leads 3a of the electrical supply cables in sockets 3b, and the supports 7 are capable of being fixed to the housing 6. The said unit 1 rotates into a position (see FIGS. 1 and 2) such as to accommodate the contact plug or pin connectors 4 which are connected to the circuit on the electronic board 5. On the frame 10 which supports the board with the electronic circuit 5 and the bulb on the front side, the pins 8 which are completely by the bayonet fixing of the said frame 10 to the box 6 are inserted into the respective sockets 8'.

The similar pins 9 on the shield 11 are arranged for rapid fixing to the box assembly 6 already bearing the frame 10 by bayonet-type insertion of the said pins 9 and rotating in the sockets 9'. The holes 12 are suitable for fixing the box 6 to the wall or ceiling while the sockets 13 are suitable for accommodating the batteries for emergency lighting. It is apparent that a single operation suffices to accomplish both the mechanical connection and the electrical connection to the external cables and to the bulbs, with the capability for rapid and simple disconnection in case of need.

Suitable holes for fixing to the wall or to the ceiling, and a hold for the insertion of the electric cables, are made in the housing.

Installation of an electronic unit according to the present invention is relatively simple and rapid. Mechanical fixing of the leak-tight housing or casing 6 to the wall or ceiling is accomplished using holes 12. Mechanical fixing of the unit 10 to the casing 6 is accomplished using pins 8 and sockets 8'. Mechanical fixing of the shield 11 to the assembled casing 6 and unit 10 is accomplished using pins 9 and sockets 9'. Electrical connection of the electronic part 5 of unit 10 to the mains supply leads is accomplished using rotatable connector unit 1. The mains supply leads are connected to connector unit 1 in a first position using screws 3. The connector unit 1 is rotated to a second position for electrical connection to electronic part 5 using pin connectors 4 and electrical contacts in the form of female sockets 14 provided on the connector unit 1.

The present invention, which is illustrated and described in a diagrammatical and exemplary manner, is to be understood as applicable to electronic units of various other kinds, e.g. smoke detectors, which are for mounting on a wall or ceiling.

In practical operation, in fact, the shape and dimensions and also the materials used may be varied in accordance with requirements necessitated by factors such as type of electronic unit to be installed, available space and environment.

I claim:

1. An electrical connection system comprising a first housing part provided with an electrically-operated device with terminals for supplying electrical power to said device, a second housing part adapted to be releasably connected to the first housing part, the second housing part including a connector for electrically connecting said terminals of said device to an electrical supply, the connector including electrical contacts for receiving said terminals and connections for leads from said supply, wherein said connector has a pivotal mounting on supports in said second housing part for selective pivotal movement of the connector between first and second pivotal positions respectively facilitating attachment of the terminals to said contacts and attachment of the leads to said connections, a third housing part in the form of a cover and adapted to be releasably connected to said first and second housing parts over the first housing part, so that the third housing part acts as a shield for at least the first housing part and the electrically-operated device, and fastener means for releasably connecting said first, second and third housing parts together.

2. The invention defined in claim 1 wherein said pivotal positions are separated by 90 degrees.

3. The invention defined in claim 1 wherein the terminals are male terminals and the contacts are sockets.

4. The invention defined in claim 1 wherein the connections are screw connections.

5. The invention defined in claim 1 wherein said fastener means includes bayonet-type fastener means carried by one of said first and second housing parts and socket means in said other of said first and second housing parts for releasably connecting the first and second housing parts together.

6. The invention as defined in claim 1 wherein said fastener means includes bayonet-type fastener means carried by one of said second and third housing parts and socket means in the other of said second and third housing parts for releasably connecting the second and third housing parts together.

* * * * *